US010815879B2

(12) United States Patent
Hoshikawa et al.

(10) Patent No.: US 10,815,879 B2
(45) Date of Patent: Oct. 27, 2020

(54) CONTROL METHOD FOR INTERNAL COMBUSTION ENGINE AND CONTROL DEVICE FOR INTERNAL COMBUSTION ENGINE

(71) Applicant: NISSAN MOTOR CO., LTD., Yokohama-shi, Kanagawa (JP)

(72) Inventors: Hiroaki Hoshikawa, Kanagawa (JP); Kakuzou Kaneko, Kanagawa (JP); Yukinaga Moriguchi, Kanagawa (JP); Kazuo Muraki, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 16/609,323

(22) PCT Filed: May 1, 2017

(86) PCT No.: PCT/JP2017/017109
§ 371 (c)(1),
(2) Date: Oct. 29, 2019

(87) PCT Pub. No.: WO2018/203360
PCT Pub. Date: Nov. 8, 2018

(65) Prior Publication Data
US 2020/0056537 A1 Feb. 20, 2020

(51) Int. Cl.
*F02B 75/04* (2006.01)
*F02D 15/02* (2006.01)
(Continued)

(52) U.S. Cl.
CPC ..... *F02B 75/04* (2013.01); *F02D 15/02* (2013.01); *F02D 15/04* (2013.01); *F02D 37/02* (2013.01); *F02D 41/06* (2013.01); *F02D 43/00* (2013.01)

(58) Field of Classification Search
CPC ..... F02B 75/04; F02B 75/041; F02B 75/042; F02B 75/044; F02B 75/045; F02B 75/047;
(Continued)

(56) References Cited

U.S. PATENT DOCUMENTS

2011/0271920 A1* 11/2011 Akihisa ..... F02D 13/0234 123/90.15
2012/0145128 A1* 6/2012 Tateno ..... F02D 15/04 123/48 B
(Continued)

FOREIGN PATENT DOCUMENTS

JP 2005-69131 A 3/2005
JP 2007-146701 A 6/2007
(Continued)

*Primary Examiner* — Jacob M Amick
(74) *Attorney, Agent, or Firm* — Foley & Lardner LLP

(57) ABSTRACT

A control method and a control device are provided for an internal combustion engine structured to vary a mechanical compression ratio by varying a range of slide of a piston with respect to a cylinder bore. A control process includes: acquiring a temperature correlating with a cylinder bore wall temperature; fixing the mechanical compression ratio to a preset compression ratio point, in response to a condition that the acquired temperature is lower than a preset temperature point; and setting the preset temperature point higher than a point corresponding to a point of the cylinder bore wall temperature at which condensed water occurs in the cylinder bore.

11 Claims, 5 Drawing Sheets

(51) Int. Cl.

| | |
|---|---|
| *F02D 15/04* | (2006.01) |
| *F02D 37/02* | (2006.01) |
| *F02D 41/06* | (2006.01) |
| *F02D 43/00* | (2006.01) |

(58) Field of Classification Search
CPC ..... F02B 75/048; F02D 15/02; F02D 15/04; F02D 37/02; F02D 41/06; F02D 43/00
See application file for complete search history.

(56) References Cited

U.S. PATENT DOCUMENTS

| | | | | |
|---|---|---|---|---|
| 2014/0283786 | A1* | 9/2014 | Nakasaka | F02P 5/145 123/406.19 |
| 2015/0152793 | A1* | 6/2015 | Matsuda | F02D 13/0203 60/285 |
| 2018/0245522 | A1* | 8/2018 | Yamashita | F02B 75/041 |
| 2019/0040836 | A1* | 2/2019 | Toyama | F02P 5/15 |

FOREIGN PATENT DOCUMENTS

| | | | |
|---|---|---|---|
| JP | 2009-215913 | A | 9/2009 |
| JP | 2009-293496 | A | 12/2009 |
| JP | 2012-21459 | A | 2/2012 |
| JP | 2013-2370 | A | 1/2013 |
| JP | 2016-113945 | A | 6/2016 |
| WO | WO-2014/119354 | A1 | 8/2014 |
| WO | WO 2014/141729 | A1 | 9/2014 |

* cited by examiner

CONTROL METHOD FOR INTERNAL COMBUSTION ENGINE AND CONTROL DEVICE FOR INTERNAL COMBUSTION ENGINE

BACKGROUND

The present invention relates to a control device and a control method for an internal combustion engine structured to vary a compression ratio.

A patent document 1 discloses an internal combustion engine that includes: an in-cylinder-injection-use fuel injection valve for injecting fuel into a combustion chamber; a port-injection-use fuel injection valve for injecting fuel into an intake port; and a variable compression ratio mechanism structured to vary a mechanical compression ratio.

According to patent document 1, when corrosion may occur in a tip end portion of a nozzle of the in-cylinder-injection-use fuel injection valve, the occurrence of corrosion is suppressed by increasing the mechanical compression ratio of the internal combustion engine, and allocating an entire quantity of fuel injection to port injection from the port-injection-use fuel injection valve.

However, patent document 1 merely addresses suppression of the occurrence of corrosion in the tip end portion of the in-cylinder-injection-use fuel injection valve.

For example, when a temperature of cooling water of the internal combustion engine is low, adhesion of condensed water on an inner peripheral surface of a cylinder bore may cause corrosion in the inner peripheral surface of the cylinder bore by acid formed from condensed water and nitrogen oxides (NOx) contained in combustion gas.

If the mechanical compression ratio of the internal combustion engine is controlled variably under a condition that condensed water adheres to the inner peripheral surface of the cylinder bore, a piston ring slides on a corroded portion of the cylinder bore, and thereby causes a corroded piece to fall off the corroded portion. When the mechanical compression ratio becomes low, a part which the corroded piece falls off may be newly corroded so that corrosion of the cylinder bore may progress.

Namely, there is room for improvement in delaying the progress of corrosion which may occur in the internal combustion engine structured to vary the mechanical compression ratio.

PRIOR ART DOCUMENT(S)

Patent Document(s)

Patent Document 1: Japanese Patent Application Publication No. 2016-113945

SUMMARY

For an internal combustion engine structured to vary a mechanical compression ratio by varying a range of slide of a piston with respect to a cylinder bore, one or more embodiments of the present invention includes: acquiring a temperature correlating with a cylinder bore wall temperature; and fixing the mechanical compression ratio to a preset compression ratio point, in response to a condition that the acquired temperature is lower than a preset temperature point.

According to one or more embodiments of the present invention, by fixing the mechanical compression ratio while the cylinder bore wall temperature is low, it is possible to prevent a piston ring from sliding on a corroded surface of the cylinder bore, and thereby delay the progress of corrosion.

DETAILED DESCRIPTION

The following describes an embodiment of the present invention in detail with reference to the drawings.

Figure 1:
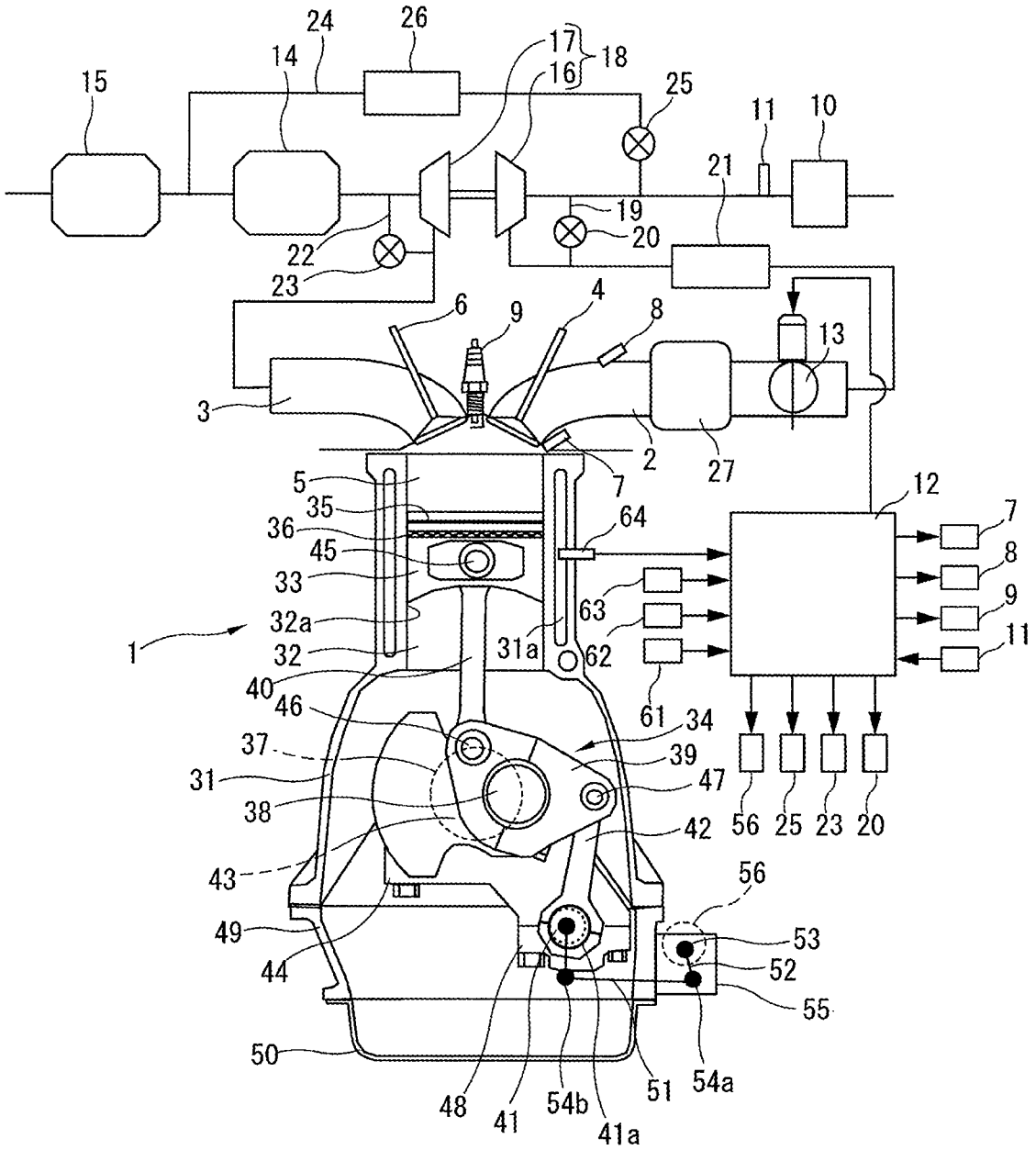
FIG. 1 is an illustrative view showing schematic configuration of a control device of an internal combustion engine according to the present embodiment.

FIG. 1 is an illustrative view showing schematic configuration of a control device of an internal combustion engine 1 according to the present embodiment, to which a control method of internal combustion engine 1 according to the present embodiment is applicable.

Internal combustion engine 1 is mounted as a drive source on a vehicle such as an automotive vehicle, including an intake passage 2 and an exhaust passage 3. Intake passage 2 is connected to a combustion chamber 5 via an intake valve 4. Exhaust passage 3 is connected to combustion chamber 5 via an exhaust valve 6.

Internal combustion engine 1 includes a first fuel injection valve 7 and a second fuel injection valve 8. First fuel injection valve 7 injects fuel directly into combustion chamber 5. Second fuel injection valve 8 injects fuel into intake passage 2 upstream of intake valve 4. The fuel injected by first fuel injection valve 7 and second fuel injection valve 8 is ignited in combustion chamber 5 by a spark plug 9.

Intake passage 2 is provided with an air cleaner 10, an air flow meter 11, and a throttle valve 13. Air cleaner 10 collects foreign matter in intake air. Air flow meter 11 measures a quantity of intake air. Throttle valve 13 is an electronic throttle valve whose opening is controlled in accordance with a control signal from a control unit 12.

Air flow meter 11 is disposed upstream of throttle valve 13. Air flow meter 11 contains a temperature sensor, and is structured to measure a temperature of intake air at an intake air inlet. Air cleaner 10 is disposed upstream of air flow meter 11.

Exhaust passage 3 is provided with an upstream exhaust catalyst 14 such as a three-way catalyst, and a downstream exhaust catalyst 15 such as a NOx trap catalyst. Downstream exhaust catalyst 15 is disposed downstream of upstream exhaust catalyst 14.

Internal combustion engine 1 further includes a turbocharger 18. Turbocharger 18 includes a compressor 16 disposed in intake passage 2, and an exhaust turbine 17 disposed in exhaust passage 3, wherein compressor 16 and exhaust turbine 17 are arranged coaxially. Compressor 16 is disposed upstream of throttle valve 13, and downstream of air flow meter 11. Exhaust turbine 17 is disposed upstream of upstream exhaust catalyst 14.

Intake passage 2 is connected to a recirculation passage 19. Recirculation passage 19 includes a first end connected to a section of intake passage 2 upstream of compressor 16, and a second end connected to a section of intake passage 2 downstream of compressor 16.

Recirculation passage 19 is provided with a recirculation valve 20. Recirculation valve 20 is an electronic recirculation valve structured to relieve a boost pressure from the section downstream of compressor 16 to the section upstream of compressor 16. Recirculation valve 20 may be implemented by a so-called check valve structured to open only when pressure downstream of compressor 16 becomes higher than or equal to a preset pressure point.

Intake passage 2 is further provided with an intercooler 21. Intercooler 21 is disposed downstream of compressor 16, and is structured to cool intake air that is compressed (pressurized) by compressor 16, for improvement in charging efficiency. Intercooler 21 is disposed downstream of the downstream end of recirculation passage 19, and upstream of throttle valve 13.

Exhaust passage 3 is connected to an exhaust bypass passage 22. Exhaust bypass passage 22 bypasses exhaust turbine 17, and connects a section upstream of exhaust turbine 17 to a section downstream of exhaust turbine 17. Exhaust bypass passage 22 includes a downstream end connected to a section of exhaust passage 3 upstream of upstream exhaust catalyst 14. Exhaust bypass passage 22 is provided with a wastegate valve 23. Wastegate valve 23 is an electronic wastegate valve that controls a quantity of exhaust gas in exhaust bypass passage 22. Wastegate valve 23 is structured to bypass a part of exhaust gas, which is to be introduced to exhaust turbine 17, to the section downstream of exhaust turbine 17, and thereby control the boost pressure of internal combustion engine 1.

Internal combustion engine 1 further includes an EGR passage 24. EGR passage 24 is branched from exhaust passage 3 and connected to intake passage 2, and is structured to perform exhaust gas recirculation (EGR) that introduces (recirculates) a part of exhaust gas as EGR gas from exhaust passage 3 into intake passage 2. EGR passage 24 includes a first end connected to a section of exhaust passage 3 between upstream exhaust catalyst 14 and downstream exhaust catalyst 15, and a second end connected to a section of intake passage 2 downstream of air flow meter 11 and upstream of compressor 16. EGR passage 24 is provided with an EGR valve 25 and an EGR cooler 26. EGR valve 25 is an electronic EGR valve that controls a flow rate of EGR gas in EGR passage 24. EGR cooler 26 is structured to cool EGR gas. As shown in FIG. 1, intake passage 2 includes a collector section 27.

Internal combustion engine 1 further includes a variable compression ratio mechanism 34 that is structured to vary a mechanical compression ratio of internal combustion engine 1 by varying a top dead center position of a piston 33 that slides in a cylinder bore 32 of a cylinder block 31. Namely, internal combustion engine 1 is structured to vary the mechanical compression ratio by varying a range of slide of piston 33 with respect to an inner peripheral surface 32*a* of cylinder bore 32. In other words, internal combustion engine 1 is structured to vary the mechanical compression ratio by varying a range of slide of piston 33 with respect to the cylinder. The mechanical compression ratio is determined by the top dead center position and bottom dead center position of piston 33.

Piston 33 includes a first piston ring 35 and a second piston ring 36, wherein first piston ring 35 is closer to a piston crown of piston 33 than second piston ring 36. Each of first piston ring 35 and second piston ring 36 is a so-called compression ring, and serves to eliminate a clearance between inner peripheral surface 32*a* of cylinder bore 32 and piston 33, and thereby maintain hermeticity.

Variable compression ratio mechanism 34 employs a multilink piston-crank mechanism in which piston 33 is linked with a crank pin 38 of a crankshaft 37 via a plurality of links. Variable compression ratio mechanism 34 includes a lower link 39, an upper link 40, a control shaft 41, and a control link 42. Lower link 39 is rotatably attached to crank pin 38. Upper link 40 links lower link 39 with piston 33. Control shaft 41 includes an eccentric shaft part 41*a*. Control link 42 links eccentric shaft part 41*a* of control shaft 41 with lower link 39.

Crankshaft 37 includes journals 43 and crank pins 38. Journal 43 is rotatably supported between cylinder block 31 and a crankshaft bearing bracket 44.

Upper link 40 includes a first end rotatably attached to a piston pin 45, and a second end rotatably linked with lower link 39 via a first connection pin 46. Control link 42 includes a first end rotatably linked with lower link 39 via a second connection pin 47, and a second end rotatably attached to eccentric shaft part 41*a* of control shaft 41. First connection pin 46 and second connection pin 47 are pressed into and fixed to lower link 39.

Control shaft 41 is arranged in parallel to crankshaft 37, and is rotatably supported by cylinder block 31. Specifically, control shaft 41 is rotatably supported between crankshaft bearing bracket 44 and a control shaft bearing bracket 48.

Cylinder block 31 includes a lower part to which an oil pan upper part 49 is attached. Oil pan upper part 49 includes a lower part to which an oil pan lower part 50 is attached.

Control shaft 41 receives input of rotation of a drive shaft 53 that is transmitted via an actuator link 51 and a drive shaft arm 52. Drive shaft 53 is disposed outside of oil pan upper part 49, and is arranged parallel to control shaft 41. Drive shaft arm 52 is fixed to drive shaft 53.

Actuator link 51 includes a first end rotatably linked with drive shaft arm 52 via a pin 54*a*. Actuator link 51 is a narrow rod-shaped member that is arranged to be perpendicular to control shaft 41, and includes a second end rotatably linked via a pin 54*b* with a portion of control shaft 41 eccentric from a rotation center of control shaft 41.

Drive shaft 53, drive shaft arm 52, and the first end portion of actuator link 51 are mounted in a housing 55 that is attached to a side face of oil pan upper part 49.

Drive shaft 53 includes a first end connected to an electric motor 56 as an actuator via a speed reducer not shown. Namely, drive shaft 53 is rotationally driven by electric motor 56. The rotation speed of drive shaft 53 results from reduction from the rotation speed of electric motor 56 by the speed reducer.

As drive shaft 53 is rotated by electric motor 56, actuator link 51 travels along a plane perpendicular to drive shaft 53. The travel of actuator link 51 causes a swinging motion of the place of linkage between the second end of actuator link 51 and control shaft 41, and thereby rotates control shaft 41. As control shaft 41 rotates and varies its rotational position, eccentric shaft part 41*a* varies its position, wherein eccentric shaft part 41*a* serves as a fulcrum of swinging motion of control link 42. In this way, by variation of the rotational position of control shaft 41 by electric motor 56, the attitude of lower link 39 varies, to cause a variation in piston motion (stroke characteristics) of piston 33, namely, a variation in the top dead center position and bottom dead center position of piston 33, so that the mechanical compression ratio of internal combustion engine 1 is continuously varied.

The mechanical compression ratio of internal combustion engine 1 is normally controlled by a normal compression ratio control based on an operating condition of internal combustion engine 1 (engine operating condition). The normal compression ratio control may be implemented by setting the mechanical compression ratio such that the mechanical compression ratio decreases as the operating condition of internal combustion engine 1 increases in speed and load.

Rotation of electric motor 56 is controlled by control unit 12. Namely, control unit 12 serves as a compression ratio control section to vary and fix the mechanical compression ratio of internal combustion engine 1 by variable compression ratio mechanism 34.

Control unit 12 is a publicly known digital computer that contains a CPU, a ROM, a RAM, and input/output interfaces.

Control unit 12 receives input of sensing signals from various sensors, namely, air flow meter 11, a crank angle sensor 61 for sensing a crank angle of crankshaft 37, an accelerator opening sensor 62 for sensing an amount of depression of an accelerator pedal, a rotation angle sensor 63 for sensing a rotation angle of drive shaft 53, a water temperature sensor 64 for sensing a cooling water temperature Tw, etc. Control unit 12 calculates a requested load of the internal combustion engine (i.e. engine load), based on a sensing value of accelerator opening sensor 62.

Crank angle sensor 61 is structured to measure the engine speed of internal combustion engine 1.

Water temperature sensor 64 serves as a wall temperature acquiring section to acquire a temperature of cooling water flowing around cylinder bore 32, as a temperature correlating with a cylinder bore wall temperature. In other words, water temperature sensor 64 acquires a temperature of cooling water flowing around the inner peripheral surface of the cylinder, as a temperature correlating with the cylinder bore wall temperature. The cylinder bore wall temperature is a wall temperature of inner peripheral surface 32*a* of cylinder bore 32. In other words, the cylinder bore wall temperature is a wall temperature of the inner peripheral surface of the cylinder. In the present embodiment, water temperature sensor 64 measures a temperature of cooling water in a water jacket 31*a* of cylinder block 31.

Based on the sensing signals from the various sensors, control unit 12 optimally controls the fuel injection quantity and fuel injection timing of each of first fuel injection valve 7 and second fuel injection valve 8, the ignition timing of spark plug 9, the opening of throttle valve 13, the opening of recirculation valve 20, the opening of wastegate valve 23, the opening of EGR valve 25, the mechanical compression ratio of internal combustion engine 1 set by variable compression ratio mechanism 34, etc.

When cooling water temperature Tw of internal combustion engine 1 is low, the cylinder bore wall temperature is also low. In such a condition of low water temperature, condensed water may occur in combustion chamber 5. If condensed water occurs and adheres to inner peripheral surface 32*a* of cylinder bore 32, the condensed water is mixed with nitrogen oxides (NOx) contained in combustion gas to form acid which may corrode the inner peripheral surface of the cylinder bore on the upper side of the position of the piston ring at top dead center. On the other hand, even with acid formed from condensed water and nitrogen oxides, there is no possibility that the inner peripheral surface of the cylinder bore on the lower side of the position of the piston ring at top dead center is corroded, because the acid is swept away upward.

In general, in an internal combustion engine structured to vary a mechanical compression ratio, as a top dead center position is varied, a piston ring slides on a corroded portion of an inner peripheral surface of a cylinder bore. Accordingly, as shown in FIG. 2, corrosion of the inner peripheral surface of the cylinder bore may progress due to repetition of a process that the slide of the piston ring wears the corroded portion, and the part from which a corroded piece is removed is newly corroded.

Figure 2:
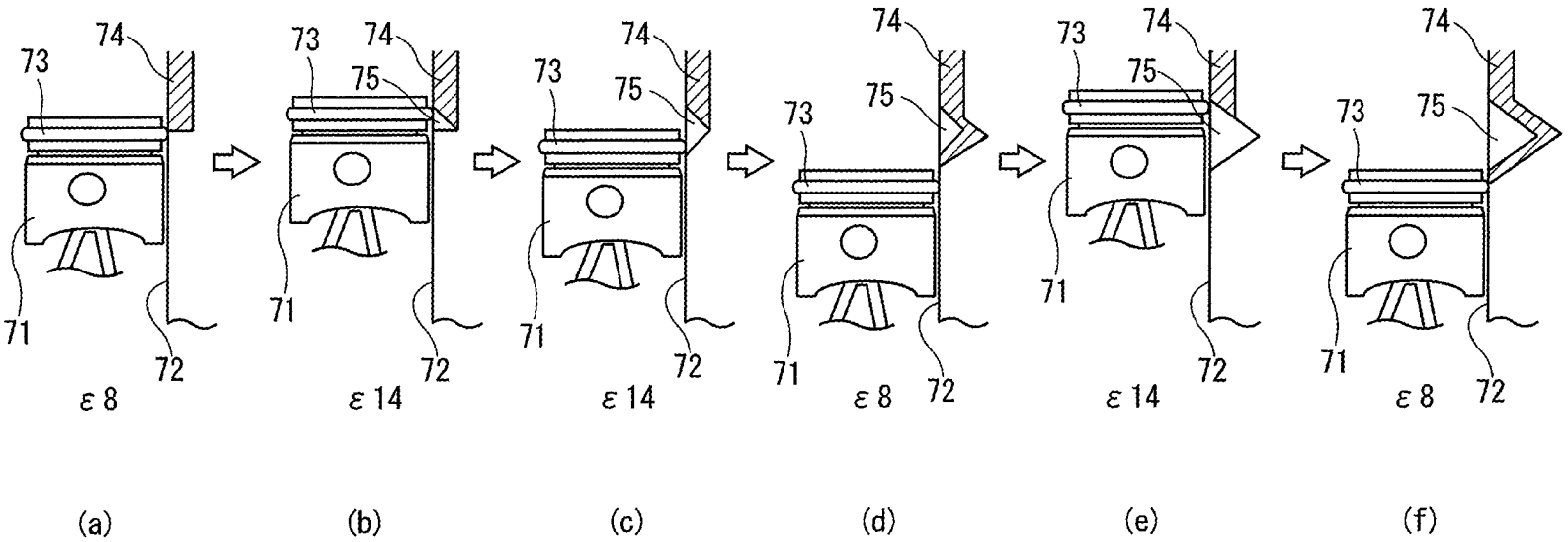
FIG. 2 is an illustrative view showing schematically a mechanism of corrosion and wear of a cylinder bore when a compression ratio is varied in cold state.

FIG. 2 is an illustrative view showing schematically a mechanism of corrosion and wear of the cylinder bore when the compression ratio is varied while the engine is in cold state. In FIG. 2, (a)-(f) represent situations at piston top dead center.

FIG. 2 shows an internal combustion engine piston 71, a cylinder bore inner peripheral surface 72, a piston ring 73, a corroded portion 74 formed in cylinder bore inner peripheral surface 72, and a recess 75 formed in a place where piston ring 73 has shaved corroded portion 74. In FIG. 2, "ε8" indicates that the compression ratio is equal to 8, and "ε14" indicates that the compression ratio is equal to 14.

As shown by (a)-(c) in FIG. 2, as the mechanical compression ratio of the internal combustion engine varies from a lower point (ε8) to a higher point (ε14), the piston top dead center position moves upward, and piston ring 73 shaves a lower end of corroded portion 74, thereby forming the recess 75 in cylinder bore inner peripheral surface 72. Recess 75 is formed after corroded portion 74 is shaved, and includes a surface not corroded (non-corroded surface). In (a)-(c) in FIG. 2, recess 75 is located radially outside of piston ring 73 located at the piston top dead center position when the mechanical compression ratio is high.

Then, as the mechanical compression ratio of the internal combustion engine is varied to the lower point (ε8) from the state of (c) in FIG. 2, the piston top dead center position moves downward. Accordingly, as shown by (d) in FIG. 2, the non-corroded surface of recess 75 is newly corroded by acid formed from condensed water and nitrogen oxides (NOx) contained in combustion gas.

Then, as the mechanical compression ratio of the internal combustion engine is varied to the higher point (ε14) from the state of (d) in FIG. 2, the piston top dead center position moves upward. Accordingly, as shown by (e) in FIG. 2, a newly corroded portion of recess 75 is shaved by piston ring 73, so that recess 75 becomes large.

Then, as the mechanical compression ratio of the internal combustion engine is varied to the lower point (ε8) from the state of (e) in FIG. 2, the piston top dead center position moves downward. Accordingly, as shown by (f) in FIG. 2, the non-corroded surface of recess 75 is newly corroded by acid formed from condensed water and nitrogen oxides (NOx) contained in combustion gas.

In this way, if the mechanical compression ratio of the internal combustion engine is controlled variably under condition that the occurrence of condensed water is possible, each variation of the mechanical compression ratio causes corrosion of cylinder bore inner peripheral surface 72 to progress.

Figure 3:
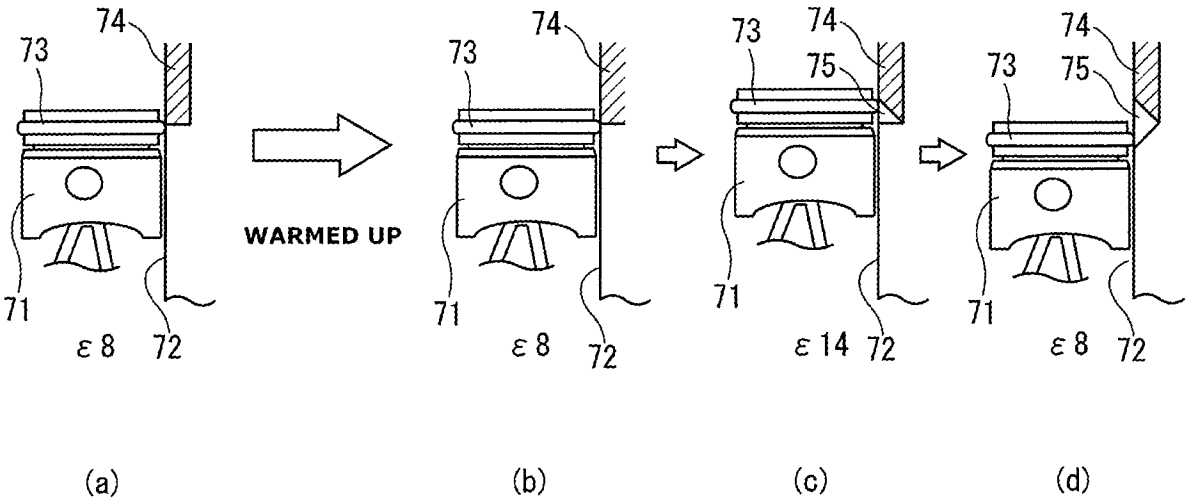
FIG. 3 is an illustrative view showing schematically a mechanism of corrosion and wear of a cylinder bore when a compression ratio is constant in cold state.

FIG. 3 is an illustrative view showing schematically a mechanism of corrosion and wear of the cylinder bore when the compression ratio is fixed while the engine is in cold state. FIG. 3 (*a*)-(*d*) show situations at piston top dead center. FIG. 3 (*a*) relates to a cold state, and FIG. 3 (*b*)-(*d*) relate to a warmed-up state.

FIG. 3 shows an internal combustion engine piston 71, a cylinder bore inner peripheral surface 72, a piston ring 73, a corroded portion 74 formed in cylinder bore inner peripheral surface 72, and a recess 75 formed in a place where piston ring 73 has shaved corroded portion 74. In FIG. 2, "ε8" indicates that the compression ratio is equal to 8, and "ε14" indicates that the compression ratio is equal to 14.

As shown by (a) in FIG. 3, when the mechanical compression ratio of the internal combustion engine is fixed to a preset compression ratio point such as ε8 under condition that the internal combustion engine is in cold state, piston ring 73 does not slide on corroded portion 74 formed in cylinder bore inner peripheral surface 72 on the upper side of the position of piston ring 73 at top dead center. Accordingly, corrosion of cylinder bore inner peripheral surface 72 does not progress while the engine is in cold state.

After completion of warming-up of the internal combustion engine, the mechanical compression ratio of the internal combustion engine is controlled variably as shown by (b)-(d) in FIG. 3. Since no condensed water occurs after completion of warming-up, even if variation of the mechanical compression ratio of the internal combustion engine causes piston ring 73 to shave the lower end of corroded portion 74, and thereby form recess 75, the non-corroded surface of recess 75 is not newly corroded.

From this viewpoint, according to the present embodiment, while the wall temperature of inner peripheral surface 32*a* of cylinder bore 32 is low, the mechanical compression ratio of internal combustion engine 1 is fixed. Specifically, it fixes the mechanical compression ratio of internal combustion engine 1 to the preset compression ratio point, in response to a condition that cooling water temperature Tw in water jacket 31*a* of cylinder block 31 is lower than preset temperature point Twth, wherein cooling water temperature Tw correlates with the cylinder bore wall temperature.

Preset temperature point Twth is set higher than a point corresponding to a point of the cylinder bore wall temperature at which condensed water occurs on inner peripheral surface 32*a* of cylinder bore 32. In other words, preset temperature point Twth is set lower than a point corresponding to a point of the cylinder bore wall temperature at which no condensed water occurs on inner peripheral surface 32*a* of cylinder bore 32. For example, preset temperature point Twth is set to the lowest point corresponding to the lowest point of the cylinder bore wall temperature at which no condensed water occurs on inner peripheral surface 32*a* of cylinder bore 32.

This prevents first piston ring 35 from sliding on a corroded portion of cylinder bore 32, and thereby serves to delay the progress of corrosion. The corroded portion of cylinder bore 32 is a portion of inner peripheral surface 32*a* of cylinder bore 32 on the cylinder head side (upper side) of first piston ring 35. In other words, the corroded portion of cylinder bore 32 is a portion of the bore surface on the upper side of the piston top ring.

Corrosion of cylinder bore 32 is caused by acid formed from nitrogen oxides (NOx) contained in combustion gas and condensed water adhered to inner peripheral surface 32*a* of cylinder bore 32. While condensed water may occur, fixation of the mechanical compression ratio of internal combustion engine 1 to the preset compression ratio point serves to reliably delay the progress of corrosion.

The preset compression ratio point to which the mechanical compression ratio of internal combustion engine 1 is fixed when in cold state is set to an intermediate compression ratio point between a minimum compression ratio point and a maximum compression ratio point of a range of control such that the position of first piston ring 35 at the preset compression ratio point is set higher than the position of second piston ring 36 when the mechanical compression ratio is controlled to the maximum compression ratio point of the range of control. For convenience of explanation in the following description, the minimum compression ratio point of the range of control is referred to simply as minimum compression ratio point, and the maximum compression ratio point of the range of control is referred to simply as maximum compression ratio point, and the intermediate compression ratio point between the minimum compression ratio point and the maximum compression ratio point of the range of control is referred to simply as intermediate compression ratio point.

Figure 4:
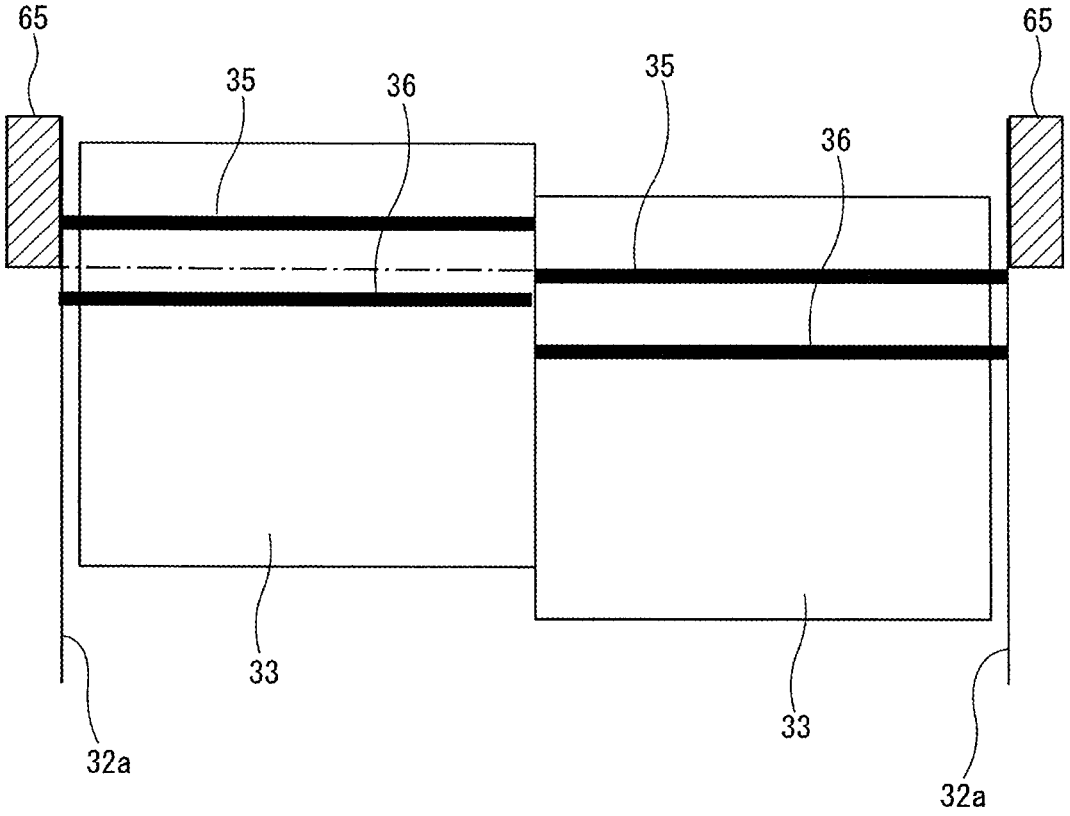
FIG. 4 is an illustrative view showing a related part of the internal combustion engine according to the present embodiment.

FIG. 4 is an illustrative view showing a related part of the internal combustion engine according to the present embodiment, specifically showing a piston position when the mechanical compression ratio is at the maximum compression ratio point, and a piston position when the mechanical compression ratio is at the intermediate compression ratio point, in comparison. Specifically, the left half of FIG. 4 shows a condition that the mechanical compression ratio is at the maximum compression ratio point, and the right half of FIG. 4 shows a condition that the mechanical compression ratio is at the intermediate compression ratio point.

As shown in FIG. 4, the setting that the preset compression ratio point is set to the intermediate compression ratio point, and the position of first piston ring 35 at the preset compression ratio point is set higher than the position of second piston ring 36 when the mechanical compression ratio is controlled to the maximum compression ratio point, serves to prevent second piston ring 36 from contacting a corroded portion 65 of cylinder bore 32, both at the piston position of top dead center under the maximum compression ratio point and at the piston position of top dead center under the preset compression ratio point.

When the control to vary the mechanical compression ratio is permitted to set the mechanical compression ratio to the maximum compression ratio point, second piston ring 36 is reliably in contact with the non-corroded surface of cylinder bore 32, thereby ensuring the sealing.

The corroded portion 65 is a portion of inner peripheral surface 32*a* of cylinder bore 32 which is corroded by acid formed from condensed water and nitrogen oxides (NOx) contained in combustion gas.

The feature that the preset compression ratio point is different from the maximum compression ratio point, serves to allow relatively high load operation.

The preset compression ratio point may be set to the maximum compression ratio point, instead of the intermediate compression ratio point. In this case, corroded portion 65 of inner peripheral surface 32*a* of cylinder bore 32 is maintained out of slide with first and second piston rings 35, 36, thus delaying the progress of corrosion due to wear of corroded portion 65 of inner peripheral surface 32*a* of cylinder bore 32. However, in case of the setting of the preset compression ratio point to the maximum compression ratio point, high load operation is limited by a requirement of knocking avoidance.

Since the cylinder bore wall temperature correlates significantly with the temperature of cooling water flowing around cylinder bore 32, the use of the sensed value of water temperature sensor 64 as the temperature correlating with the cylinder bore wall temperature allows application to the internal combustion engine provided with no sensor for directly sensing the temperature of inner peripheral surface 32*a* of cylinder bore 32.

When cooling water temperature Tw becomes higher than or equal to preset temperature point Twth, the fixation of the compression ratio of variable compression ratio mechanism 34 to the preset compression ratio point is terminated, and the normal compression ratio control is started.

In this way, when the condition that no corrosion occurs (the condition that no condensed water occurs) is established, it is possible to quickly shift into the normal compression ratio control.

Figure 5:
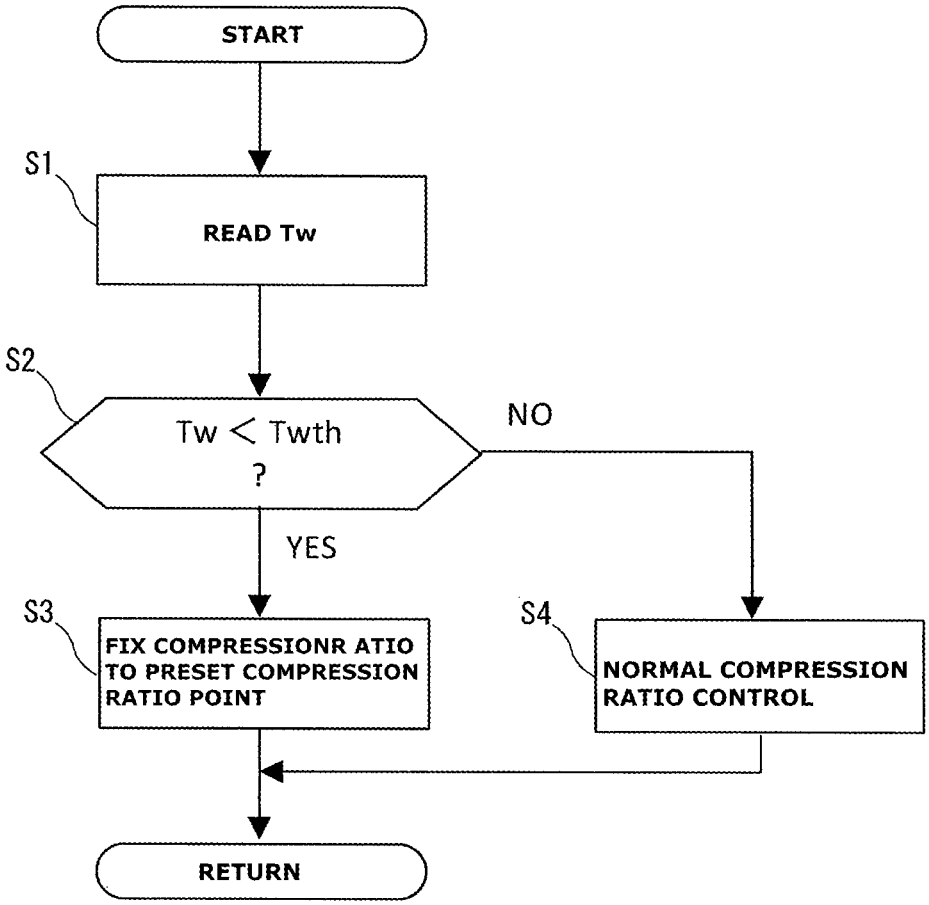
FIG. 5 is a flow chart showing a flow of control of the internal combustion engine according to the present embodiment.

FIG. 5 is a flow chart showing a flow of control according to the present embodiment.

At Step S1, it reads cooling water temperature Tw. At Step S2, it determines whether or not cooling water temperature Tw read at Step S1 is lower than preset temperature point Twth. When determining at Step S2 that cooling water temperature Tw is lower than preset temperature point Twth, it proceeds to Step S3. When determining at Step S2 that cooling water temperature Tw is higher than or equal to preset temperature point Twth, it proceeds to Step S4. At Step S3, it fixes the mechanical compression ratio of internal combustion engine 1 to the preset compression ratio point. At Step S4, it performs the normal compression ratio control to vary the mechanical compression ratio of internal combustion engine 1 variably in accordance with the operating condition.

The invention claimed is:

1. A control method for an internal combustion engine structured to vary a mechanical compression ratio by varying a range of slide of a piston with respect to a cylinder bore, the control method comprising:

acquiring a temperature correlating with a cylinder bore wall temperature;

fixing the mechanical compression ratio to a preset compression ratio point, in response to a condition that the acquired temperature is lower than a preset temperature point; and setting the preset temperature point higher than a point corresponding to a point of the cylinder bore wall temperature at which condensed water occurs in the cylinder bore.

2. The control method as claimed in claim 1, wherein the piston includes a piston crown, a first piston ring, and a second piston ring, and wherein the first piston ring is closer to the piston crown than the second piston ring, the control method comprising:

setting the preset compression ratio point to an intermediate compression ratio point between a minimum compression ratio point and a maximum compression ratio point of a range of control, wherein the first piston ring is higher in position when the mechanical compression ratio is at the preset compression ratio point than the second piston ring when the mechanical compression ratio is controlled to the maximum compression ratio point.

3. The control method as claimed in claim 1, comprising:

setting the preset compression ratio point to the maximum compression ratio point of the range of control.

4. The control method as claimed in claim 1 comprising:

acquiring a temperature of cooling water flowing around the cylinder bore as the temperature correlating with the cylinder bore wall temperature.

5. The control method as claimed in claim 1, comprising:

performing a variable compression ratio control based on an engine operating condition, in response to a condition that the acquired temperature correlating with the cylinder bore wall temperature becomes higher than or equal to the preset temperature point.

6. A control device for an internal combustion engine structured to vary a mechanical compression ratio by varying a range of slide of a piston with respect to a cylinder bore, the control device comprising:

a wall temperature acquiring section structured to acquire a temperature correlating with a cylinder bore wall temperature; and a compression ratio control section configured to fix the mechanical compression ratio to a preset compression ratio point, in response to a condition that the acquired temperature is lower than a preset temperature point;

wherein the preset temperature point is set higher than a point corresponding to a point of the cylinder bore wall temperature at which condensed water occurs in the cylinder bore.

7. The control method as claimed in claim 2, comprising:

acquiring a temperature of cooling water flowing around the cylinder bore as the temperature correlating with the cylinder bore wall temperature.

8. The control method as claimed in claim 3, comprising:

acquiring a temperature of cooling water flowing around the cylinder bore as the temperature correlating with the cylinder bore wall temperature.

9. The control method as claimed in claim 2, comprising:

performing a variable compression ratio control based on an engine operating condition, in response to a condition that the acquired temperature correlating with the cylinder bore wall temperature becomes higher than or equal to the preset temperature point.

10. The control method as claimed in claim 3, comprising:

performing a variable compression ratio control based on an engine operating condition, in response to a condition that the acquired temperature correlating with the cylinder bore wall temperature becomes higher than or equal to the preset temperature point.

11. The control method as claimed in claim 4, comprising:

performing a variable compression ratio control based on an engine operating condition, in response to a condition that the acquired temperature correlating with the cylinder bore wall temperature becomes higher than or equal to the preset temperature point.

* * * * *